United States Patent [19]

Schupphaus

[11] Patent Number: 4,588,230

[45] Date of Patent: May 13, 1986

[54] CONTROL FOR MINING MACHINE

[75] Inventor: Herbert Schupphaus, Bochum, Fed. Rep. of Germany

[73] Assignee: Gebr. Eickhoff Maschinenfabrik und Eisengiesserei m.b.H., Bochum, Fed. Rep. of Germany

[21] Appl. No.: 725,916

[22] Filed: Apr. 22, 1985

[30] Foreign Application Priority Data

Apr. 26, 1984 [DE] Fed. Rep. of Germany ..... 3415502

[51] Int. Cl.[4] ..... E21C 35/08; E21C 35/24

[52] U.S. Cl. ..... 299/1; 299/75

[58] Field of Search ..... 299/1, 75

[56] References Cited

U.S. PATENT DOCUMENTS 4,023,861 5/1977 Schnell ..... 299/1

*Primary Examiner*—Stephen J. Novosad
*Assistant Examiner*—Michael Goodwin
*Attorney, Agent, or Firm*—Thomas H. Murray

[57] ABSTRACT

A control for a mining machine having means for traversing a ground surface and a universally-pivotal carrier arm of variable length which carries at its forward end a cutter drum. A displacement pickup is responsive to forward or aft movement of the cutter drum with respect to the ground surface. Means are connected to the displacement pickup for producing a first signal when said cutter drum has moved forwardly in an amount substantially equal to its length and for thereafter producing a second signal when the cutter drum is moved backwardly in an amount equal to a fraction of its length. These signals are used to control forward or aft movement of the mining machine over the ground surface, or extension or retraction of the variable length carrier arm, to remove ribs in the side walls after a cut has been taken from the mine face area, these ribs resulting from the shape of the cutter drum and its angularity with respect to the mine roadway side walls.

8 Claims, 3 Drawing Figures

CONTROL FOR MINING MACHINE

BACKGROUND OF THE INVENTION

The present invention relates to mining machines of the general type shown, for example, in U.S Pat. No. 4,023,861. Such mining machines are provided with means for traversing a ground surface, usually caterpillars on either side of the machine frame, and have a universally-pivotal carrier arm of variable length which carries at its end a cutter drum rotatable about an axis parallel to the carrier arm axis or about the carrier arm axis itself.

In certain mining machines of this type, such as that shown in German patent application No. P 34 00 246.4, the shearing drum narrows toward the forward end of the drum and has a convex periphery and a rounded drum apex. A mining machine of this type is required to cut tunnels or mine roadways with a very smooth wall. The smoothness requirement cannot be met with a cylindrical cutter drum nor by one which narrows frustum-fashion, even when the peripheral surface of the drum is convex as in the case of the aforementioned German patent application. The irregularities which arise in the mine roadway walls are due to the fact that the pivotal axis of the cutter drum carrier arm is at the center of the roadway, meaning that the cutter drum intersects the walls at an angle; and the forward end of the drum penetrates further into the wall than its trailing end. The result is steps or ribs in the walls which must be removed to achieve the required wall smoothness. As a rule, after a cut of mine material is removed equal to approximately the length of the cutter drum, the roadway wall is smoothed by the drum making a finishing or profiling cut. At this end, the cutter drum moves backwardly from the mine face in order to contact and remove a step or rib as much as possible over its entire width.

In the use of a mining machine of the type described above, the vision of the machine operator is materially restricted by the dust evolved when the drum clears the face being mined. As a result, it is difficult for the machine operator to move the drum into the face by an amount corresponding to the drum length in order to limit the extent of the step or rib; and it is even more difficult for the operator to return the machine in the subsequent profiling or finishing cut to an intended position in which the drum can engage the remaining rib exactly in its highest part, reduce it substantially, and provide optimal smoothing of the exposed road wall.

SUMMARY OF THE INVENTION

In accordance with the present invention, means are provided in a mining machine of the type described above for removing the aforesaid steps or ribs in the mine roadway side walls without relying on the vision of the machine operator. In this regard, a displacement pickup responsive to forward and aft movement of the cutter drum with respect to the ground surface is connected to computer means for producing a first signal when the cutter drum has moved forwardly in an amount substantially equal to its length and for thereafter producing a second signal when the cutter drum has moved backwardly in an amount equal to a fraction of its length. The first and second signals can be used to actuate a visual signal for the operator who then effects manual controls or can be used to automatically interrupt the movement of the mining machine over the ground or the advance of the adjustable length carrier arm. With an arrangement of this sort, when the cutter drum enters the face, the machine operator is informed, either by a visual signal, by the stoppage of the mining machine over the ground surface, or by the stoppage of the mechanism for advancing the carrier arm, that the cutter drum has reached the required position relative to the mine face for maximizing the cutter action and for thereafter removing the aforesaid rib or step in the side walls. Complex and time-consuming maneuvering of the machine or the cutter drum carrier arm is thereby obviated.

The foresaid signals can be used, for example, to actuate a computer programmed to control both the carrier arm movement as well as the movement of the mining machine over the ground surface. When a computer of this type is used, it ensures not only satisfactory guiding of the cutter drum over the entire road cross section to remove a cut from the face but also ensures that in the profiling cut for removing the aforesaid steps or ribs, the drum automatically provides substantial removal of the rib remaining between two cutting operations.

According to another feature of the invention, the aforesaid computer can determine the amount of return movement of the mining machine in dependence upon the previous advance (i.e., upon the depth to which the cutter drum penetrates during the removal of the previous layer of the mine face, and upon the pivoting angle of the carrier arm). This feature ensures that the rib or step still remaining is engaged substantially by the drum in the finishing cut such that a relatively smooth and flat road wall is produced.

The displacement pickup can take the form of tachometers or the like associated with the high-speed gearing for the ground-traversing means which, as mentioned above, can comprise caterpillars. Alternatively, resettable angular-motion pickups or a rowel which rests on the road floor can serve as the displacement pickup. In the latter case, the rowel can be mounted on a spring-biased swing arm pivoted to the machine frame, or the caterpillars or the like can press the rowel against the road floor. In either case, the rowel remains in permanent engagement with the mine roadway floor irrespective of unevenness thereof.

Advantageously, in the case where a rowel is used, two rowels are provided, one being disposed near the left caterpillar or other ground-traversing means and the other near the right ground-traversing means. The displacement signals from the two rowels are then averaged to trigger the visual or audible signal and/or act on the ground-traversing means or the mechanism for advancing the extendable carrier arm. The use of two rowels thus avoids inaccuracies due to one of the caterpillar running gears or other ground-traversing means slipping, for example.

The above and other objects and features of the invention will become apparent from the following detailed description taken in connection with the accompanying drawings which form a part of this specification, and in which.

Figure 1:
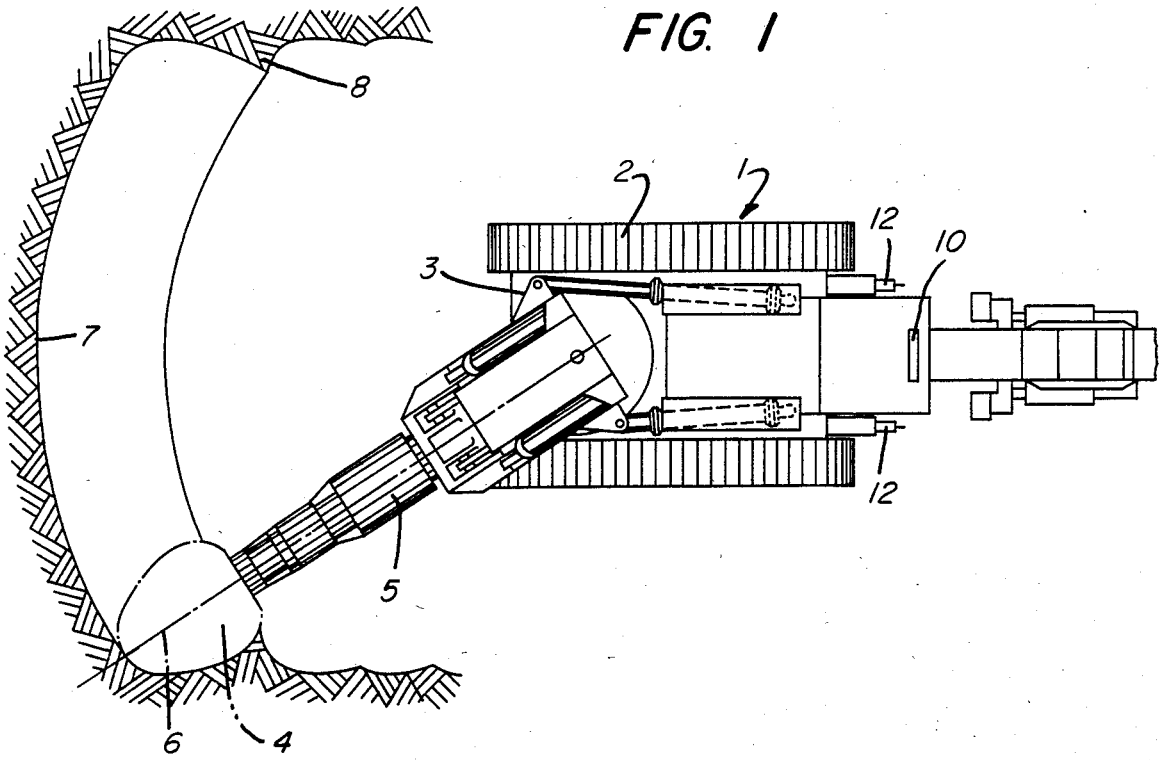
FIG. 1 is a top view of a mining machine with which the present invention may be used.
Figure 2:
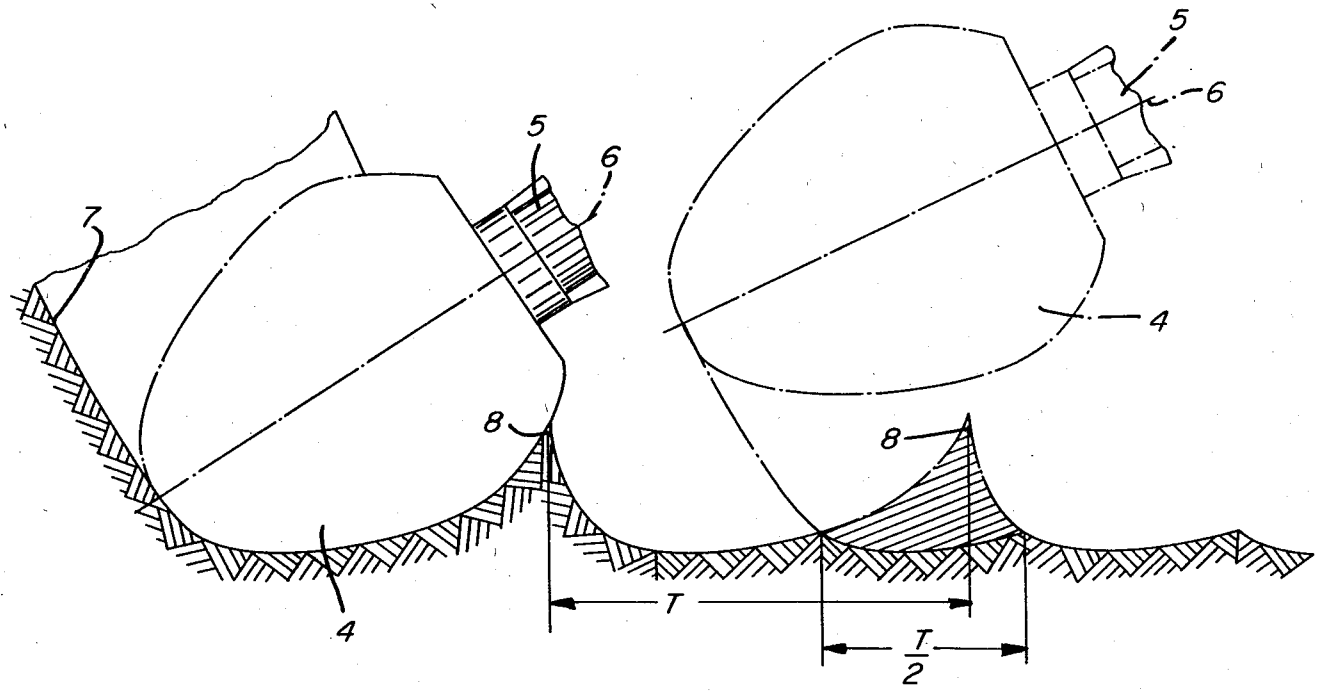
FIG. 2 is a diagrammatic view showing the cutter drum of the machine of FIG. 1 and the manner in which the ribs or steps are removed to produce a smooth mine roadway wall.

With reference now to the drawings, and particularly to FIG. 1, there is shown a mining machine 1 having ground-traversing means 2 comprising caterpillars disposed on both sides of the mining machine frame 3. The mining machine is provided with a cutter drum 4 carried at the end of a universally-pivotal carrier arm 5. As shown, the cutter drum 4 rotates around a longitudinal axis 6 which is coincident with or parallel to the axis of the carrier arm 5 and has an outer convex surface. If the hardness of the material being mined permits, the entire length of the cutter drum 4 is moved forwardly into the face area 7 being mined to cut and remove material in an amount equal to the longitudinal length of the cutter. When the entire length of the cutter drum extends into the face area 7 during a cutting operation, there remains, as shown in FIG. 2, a rib or step 8. This is due to the configuration of the cutter drum itself and will exist regardless of whether the cutter drum is contoured to have a convex outer periphery or, for example, is cylindrical. In either case, the rib 8 is left and must be subsequently removed to produce a smooth, or relatively smooth, mine roadway wall surface.

As best shown in FIG. 2, after a layer of the face area has been removed, a rib 8 extends around the entire periphery of the mine roadway at the trailing end of the cutter drum 4. As explained above, the rib 8 is formed because of the inclined position of the cutter drum 4; and its height or width depends upon the depth of drum penetration and upon the pivot angle of the carrier arm 5. To remove the rib 8, the cutter drum 4 must be moved backwardly and brought into a position in which it can engage the rib 8 to remove the same as shown by the dotted-line position of the cutter drum in FIG. 2.

As was explained above, it is very difficult for an operator to manually control the machine to remove the rib 8 due to poor visibility arising from the dust which evolves during the cutting operation. In accordance with the present invention, means are provided for automatically signaling the operator or for automatically controlling the mining machine such that if the cutter drum 4 moves forwardly by a distance T, for example, it will then move backwardly by a fraction of this amount, for example, T/2 or T/3 to remove the rib 8.

Figure 3:
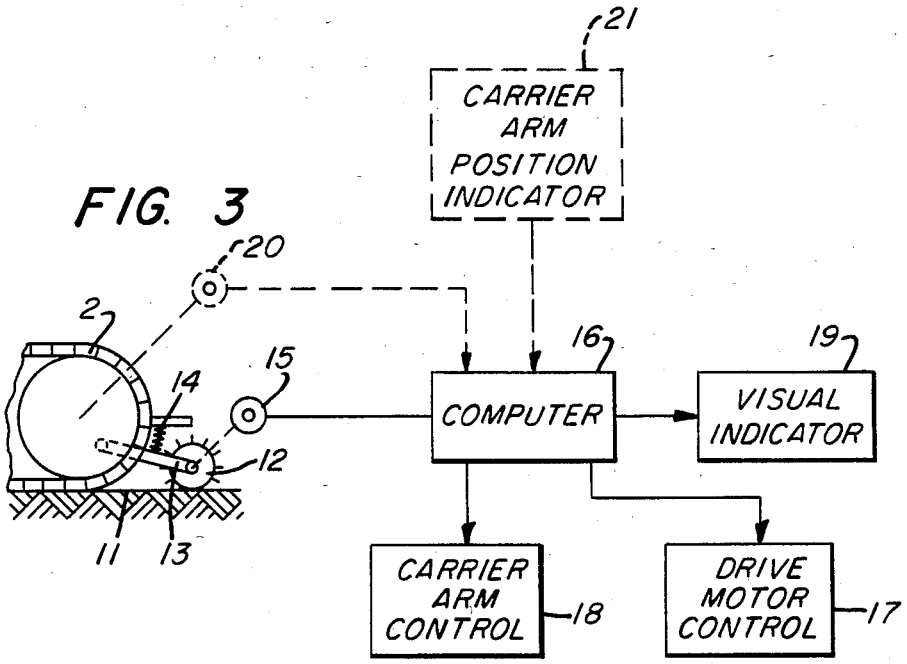
FIG. 3 illustrates one embodiment of the invention, as well as alternative embodiments of the invention, for effecting control of the mining machine of the invention.

This can be accomplished in a number of different ways as illustrated in FIG. 3. For example, a pickup in the form of a rowel 12 which runs on the mine roadway 11 can be pivotally mounted on a swing arm 13 biased by a spring 14 which presses the rowel against the floor 11. The rowel, in turn, can be connected to a tachometer 15 or the like which produces a signal proportional to actual displacement, forward or aft. This signal is fed to a computer 16 which can then produce an output signal to a drive motor control 17 for the cats 2, for example or, alternatively, can produce a signal to circuitry 18 which extends or retracts the carrier arm 5, producing somewhat the same result. It is also possible to have a dual control in which both drive motors for the cats 2 and the extension of the carrier arm 5 are controlled. Alternatively, the computer output can be applied to a visual or audible indicator 19 which will indicate to the operator when the machine has moved forwardly by a distance T or backwardly by a distance T/2, for example.

Instead of using a rowel 12, it is also possible to connect a tachometer 20 to the driving means for the cats 2. While this is shown in FIG. 3 as being connected directly to a sprocket for the cats, it can also be connected to the high-speed gearing which drives the sprocket. In any event, the tachometer 20 will produce a signal proportional to displacement of the mining machine, and hence displacement of the cutter drum 4, which is applied to the computer 16. Still another possibility is to provide a transducer 21 on the carrier arm 5 which produces a signal proportional to the elongation or retraction of that carrier arm. If the carrier arm position indicator 21 is used by itself, this implies that during the rib-removal process, the machine 1 remains stationary. On the other hand, if both the machine 1 moves and the carrier arm 5 is retracted or extended, then both the tachometer 15 or 20 and the position indicator 21 must come into play.

If desired, two rowels 12 can be used on either side of the machine frame 3. The two rowels will then produce electrical signals as they roll, the signals being used to detect the distances T and T/2, for example. When two rowels are used, the signals produced by their associated tachometers 15 are averaged in order to compensate for any disparity in measured values due to slippage of the caterpillars 2.

It will be appreciated that the computer 16 can also determine the amount of return movement of the machine 1 itself in dependence upon the previous forward movement and upon the pivot angle of the carrier arm 5 in order to bring the cutter drum 4 into the optimal cutting position relative to the rib 8.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a mining machine having means for traversing a ground surface and a universally-pivotal carrier arm of variable length which carries at its forward end a cutter drum rotatable about the axis of the carrier arm; the improvement in said mining machine which comprises:

a displacement pickup responsive to forward and aft movement of the cutter drum with respect to said ground surface, and means connected to said displacement pickup for producing a first signal when said cutter drum has moved forwardly in an amount substantially equal to its length and for thereafter producing a second signal when the cutter drum is moved backwardly in an amount equal to a fraction of its length.

2. The mining machine of claim 1 wherein said displacement pickup includes a rowel connected to said mining machine and movable over said ground surface, the rowel being connected to apparatus for producing an electrical signal proportional to forward and aft movement of the mining machine over the ground surface.

3. The mining machine of claim 1 wherein said displacement pickup is connected to driving means for the traversing means of the mining machine.

4. The mining machine of claim 1 wherein said displacement pickup measures the extension or retraction of said variable length cutter arm.

5. The mining machine of claim 1 wherein said first and second signals are applied to indicating apparatus, visible or audible to the mining machine operator, for indicating the extent of forward and aft movement of said cutter drum.

6. The mining machine of claim 1 including computer apparatus, and means for applying said first and second signals to said computer apparatus for controlling forward and aft movement of said mining machine over said ground surface.

7. The mining machine of claim 1 including computer apparatus, and means for applying said first and second signals to said computer apparatus for controlling retraction or extension of said variable length carrier arm.

8. The mining machine of claim 1 including computer apparatus responsive to said first and second signals, the computer determining the amount of return movement of the mining machine in dependence upon the amount of forward movement of the cutter drum and the angle of the carrier arm relative to the axis of the mining machine.

* * * * *